US009629428B1

(12) United States Patent
Nei

(10) Patent No.: US 9,629,428 B1
(45) Date of Patent: Apr. 25, 2017

(54) SUNSHADE DEVICE

(71) Applicant: Sintay Nei, Ladera Ranch, CA (US)

(72) Inventor: Sintay Nei, Ladera Ranch, CA (US)

( * ) Notice: Subject to any disclaimer, the term of this patent is extended or adjusted under 35 U.S.C. 154(b) by 0 days.

(21) Appl. No.: 15/043,386

(22) Filed: Feb. 12, 2016

(51) Int. Cl.
*A45B 25/18* (2006.01)
*A45B 25/02* (2006.01)

(52) U.S. Cl.
CPC ..... *A45B 25/18* (2013.01); *A45B 25/02* (2013.01)

(58) Field of Classification Search
CPC ..... A45B 25/02; A45B 25/18
USPC ..... 135/98, 31, 16, 33.2, 20.1, 33.5
See application file for complete search history.

(56) References Cited

U.S. PATENT DOCUMENTS

| | | | | | |
|---|---|---|---|---|---|
| 160,214 | A * | 2/1875 | Martin | A45B 19/10 | 135/25.31 |
| 1,774,909 | A | 7/1928 | Wells | | |
| 2,024,105 | A * | 12/1935 | Landman | A45B 25/02 | 135/33.7 |
| 2,559,421 | A * | 7/1951 | Garrett | A45B 11/00 | 108/50.12 |
| 3,456,661 | A | 2/1967 | Farley | | |
| 4,760,610 | A * | 8/1988 | Wu | A42B 1/201 | 135/16 |
| 4,838,290 | A * | 6/1989 | Wu | A45B 25/02 | 135/16 |
| 4,884,586 | A * | 12/1989 | Szu | A45B 25/02 | 135/25.34 |
| 5,307,827 | A | 5/1994 | Haddad et al. | | |
| 5,355,903 | A | 10/1994 | Haddad et al. | | |
| 5,551,464 | A | 9/1996 | Kelly | | |
| 5,894,855 | A | 4/1999 | Gefell | | |
| 7,096,875 | B2 | 8/2006 | Dubinsky-Witkowski | | |
| 7,493,908 | B2 | 2/2009 | Carter et al. | | |
| 7,533,680 | B2 | 5/2009 | Ma | | |
| 7,793,674 | B2 | 9/2010 | Elder | | |
| 7,814,920 | B2 | 10/2010 | Lenahan | | |
| 7,918,236 | B2 * | 4/2011 | Elder | A45B 11/00 | 135/16 |
| 8,051,865 | B1 | 11/2011 | Uranga | | |
| 8,104,492 | B2 | 1/2012 | Dan | | |
| 8,225,806 | B1 | 7/2012 | Simonelli | | |
| 8,469,044 | B1 | 6/2013 | Patel | | |
| 8,485,206 | B1 | 7/2013 | Rose | | |
| 2003/0079766 | A1 | 5/2003 | Arrowood et al. | | |

(Continued)

FOREIGN PATENT DOCUMENTS

| | | | | |
|---|---|---|---|---|
| AU | WO 9944458 A1 * | 9/1999 | A45B 11/00 | |
| GB | EP 0819809 A1 * | 1/1998 | A45B 23/00 | |

(Continued)

*Primary Examiner* — Noah Chandler Hawk
(74) *Attorney, Agent, or Firm* — Jafari Law Group, Inc.

(57) ABSTRACT

The invention generally relates to a sunshade apparatus such as an umbrella or sunshade that includes a canopy with extendable portions that may be positioned in a manner so as to maximize shade. In exemplary embodiments, the sunshade device includes a canopy, and a rib assembly connected to a shaft, the rib assembly including a first joint coupled to a first assembly arm, the first joint connecting a first arm extension to the rib assembly at a first angle with respect to a surface, and a second joint coupled to a second assembly arm, the second joint connecting a second arm extension to the rib assembly at a second angle with respect to the surface.

10 Claims, 10 Drawing Sheets

(56) References Cited

U.S. PATENT DOCUMENTS

| | | | | |
|---|---|---|---|---|
| 2005/0011134 | A1* | 1/2005 | Boltan | E04H 15/28 52/3 |
| 2005/0183762 | A1 | 8/2005 | Ma | |
| 2006/0278261 | A1* | 12/2006 | Marcelli | A45B 25/18 135/98 |
| 2008/0163910 | A1 | 7/2008 | Hollinger | |
| 2008/0190469 | A1 | 8/2008 | Amsel | |
| 2009/0090403 | A1 | 4/2009 | McCalla | |
| 2010/0051074 | A1 | 3/2010 | Dan | |
| 2011/0000513 | A1 | 1/2011 | Amron et al. | |
| 2011/0253185 | A1 | 10/2011 | Uranga | |
| 2013/0333735 | A1 | 12/2013 | Chen | |
| 2014/0283888 | A1 | 9/2014 | Gray | |

FOREIGN PATENT DOCUMENTS

| | | | | |
|---|---|---|---|---|
| IT | WO 2008114305 | A2 * | 9/2008 | A45B 19/12 |
| WO | WO 2007027979 | A2 * | 3/2007 | A45B 15/00 |

* cited by examiner

FIG. 3(b)
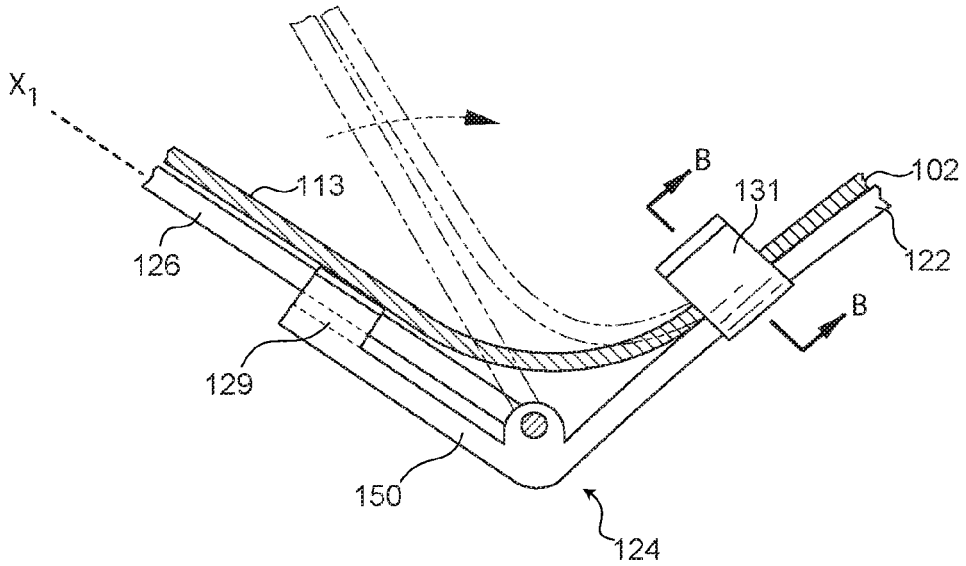
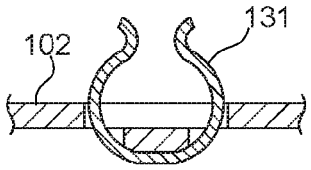
FIG. 3(c)
FIG. 3(d)
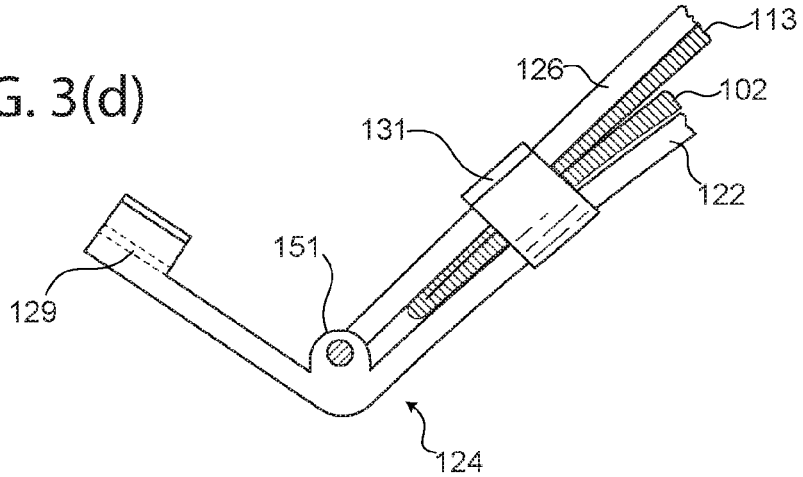

SUNSHADE DEVICE

TECHNICAL FIELD OF THE INVENTION

The present invention relates in general to a sunshade device, and more specifically, to an apparatus such as an umbrella or sunshade that includes a canopy with extendable portions that may be positioned in a manner so as to maximize shade.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

From hats to umbrellas, or sunshades, many known devices have been used to provide shade from the sun. For use in backyards, at a beach, in a park, or at any other outdoor location, sunshades are typically used by individuals or groups of people to provide shade while relaxing under the sun.

Although different sunshade devices with varying canopies, shafts, and contraptions have been developed for various purposes, one persistent problem is that such known devices include a canopy that inadequately blocks the sun. For example, known canopies often fail to block the sun, especially when the sun is not directly above the canopy—which is usually the case. Another similar problem is that known canopies must be constantly repositioned, especially during outings in which a user is relaxing throughout the course of a day. For example, during a relaxing day at the beach or at a park, a user of known sunshades typically is required to reposition the sunshade to remain within the shade. And even then, the sunshade must be constantly repositioned as the day goes by. This proves too burdensome and inadequate, and remains a problem that the prior art fails to adequately address.

The prior art tries to address these problems by providing some umbrellas or sunshades with canopies including extensions that extend to the ground and cover a circumference around the canopy; this typically includes encircling the user and also blocking the user's view—which in a way defeats the purpose of spending the day outside. Other sunshade devices implement extensions on the canopy that drag behind the user. These extensions however cannot be positioned in a manner to increase a shaded area without blocking a user's view.

Therefore, there are several problems with the current state of the art, which have not been adequately addressed. The problems persist because a need to provide a sunshade device with a canopy that maximizes a shaded area has not been adequately met. It is to these ends that the present invention has been developed.

SUMMARY OF THE INVENTION

To minimize the limitations in the prior art, and to minimize other limitations that will be apparent upon reading and understanding the present specification, the present invention describes a sunshade apparatus such as an umbrella or sunshade that includes a canopy with extendable portions that may be positioned in a manner so as to maximize shade.

A sunshade device, in accordance with an exemplary embodiment of the present invention, comprises: a canopy expanding a perimeter around a shaft; a rib assembly coupled to the shaft and the canopy; and one or more extensions pivotally coupled to the rib assembly and configured to: pivot about the perimeter of the canopy, and securely rest at one or more predetermined angles.

Another sunshade device in accordance with another exemplary embodiment of the present invention, comprises: a canopy expanding a perimeter around a shaft; and a rib assembly coupled to the shaft and the canopy, the rib assembly including: a first joint component coupled to a first assembly arm, the first joint component connecting a first extension arm to the first assembly arm of the rib assembly at a first angle with respect to a surface; and a second joint component coupled to a second assembly arm, the second joint component connecting a second extension arm to the second assembly arm of the rib assembly at a second angle with respect to the surface.

Yet another sunshade device, in accordance with another exemplary embodiment of the present invention, comprises: a canopy expanding a perimeter around a shaft; and a rib assembly coupled to the shaft and supporting the canopy, the rib assembly including one or more extensions that extend beyond the perimeter of the canopy, the one or more extensions each including: one or more extension arms for supporting one or more perimetrical extensions of the canopy; and one or more joints for positioning the one or more perimetrical extensions at various angles with respect to the perimeter of the canopy.

Yet another sunshade device in accordance with another exemplary embodiment of the present invention, comprises: a canopy expanding a perimeter around a shaft; a rib assembly coupled to the shaft and the canopy; and two extensions situated at opposite ends of the canopy, each extension pivotally coupled to the rib assembly and configured to: pivot about the perimeter of the canopy, and rest at one or more predetermined angles.

It is an objective of the present invention to provide a device that expands or maximize the shade provided by a typical sunshade's canopy.

It is another objective of the present invention to provide a canopy that may be adjusted without having to adjust a shaft of the canopy.

It is yet another objective of the present invention to provide a sunshade device with a canopy including extensions that may be positioned at one or more angles.

These and other advantages and features of the present invention are not meant as limiting objectives, but are described herein with specificity so as to make the present invention understandable to one of ordinary skill in the art.

BRIEF DESCRIPTION OF DRAWINGS

Elements in the figures have not necessarily been drawn to scale in order to enhance their clarity and improve understanding of these various elements and embodiments of the present invention. Furthermore, elements that are known to be common and well understood to those in the industry are not depicted in order to provide a clear view of the various embodiments of the invention.

FIG. 3(*b*) illustrates a first joint component of a first extension employed by the rib assembly of the sunshade device illustrated in FIG. 3(*a*).

FIG. 3(*c*) illustrates a coupling component of the sunshade device illustrated in FIG. 3(*a*).

FIG. 3(*d*) illustrates the joint component depicted in FIG. 3(*b*), showing a portion of the canopy folded and held together in place by a coupling component.

FIG. 3(*e*) illustrates a second joint component of a second extension employed by the rib assembly of the sunshade device illustrated in FIG. 3(*a*).

FIG. 3(*f*) illustrates the joint component depicted in FIG. 3(*e*), showing a portion of the canopy folded and held together in place by a coupling component.

FIG. 4(*b*) illustrates a close-up view of the joint components employed by the rib assembly of the sunshade device illustrated in FIG. 4(*a*), depicting how the extensions may be folded for storage.

FIG. 4(*c*) illustrates a close-up view of the joint components employed by the rib assembly of the sunshade device illustrated in FIG. 4(*a*), depicting how the extensions may be positioned at an angle with respect to the perimeter of the canopy.

FIG. 4(*d*) illustrates an exploded view of an exemplary joint component that may be implemented with the embodiment of FIG. 4(*a*).

FIG. 5(*b*) illustrates an exploded view of an exemplary joint component that may be implemented with the embodiment of FIG. 5(*a*).

FIG. 5(*c*) illustrates a perspective assembled view of the exemplary joint component depicted in FIG. 5(*b*).

DESCRIPTION OF THE INVENTION

Figure 1:
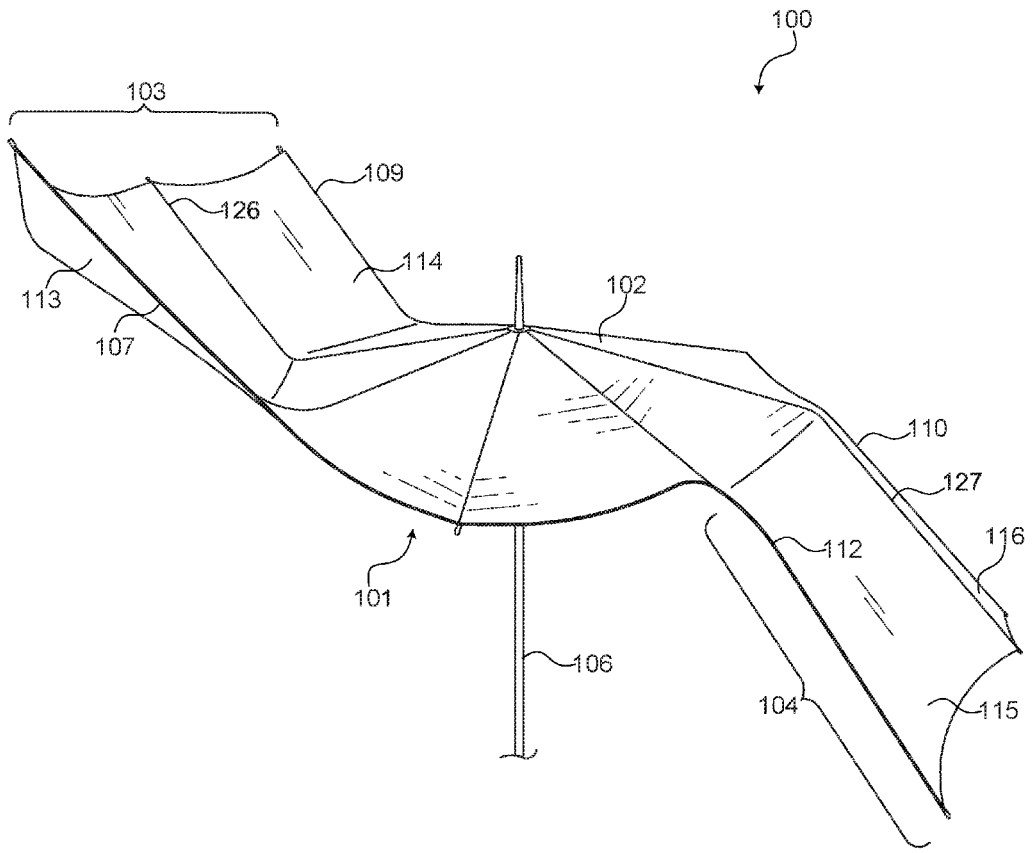
FIG. 1 illustrates a perspective view of a sunshade device in accordance with the present invention.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and any methods described herein may be modified by substituting, reordering, or adding stages to the disclosed methods. Accordingly, the following detailed description does not limit the disclosure. Instead, the proper scope of the disclosure is defined by the appended claims.

Generally, the present invention involves an apparatus such as an umbrella or sunshade device that includes a canopy with extendable portions, which may be independently positioned in a manner so as to maximize the shade typically provided by the canopy. The canopy of the sunshade typically expands a perimeter around a shaft that supports a rib assembly for folding and unfolding the canopy. One or more extensions extend from the perimeter of the canopy, comprising extending arms that support a fabric or material similar to the fabric of the canopy or even integral with portions of the canopy but which extend past the canopy's perimeter. The extensions may further include joint components situated at the tip of one or more rib assembly arms, which enable the folding and unfolding of each extension, and in some embodiments, may also enable positioning each extension at varying angles in relation to the perimeter of the canopy.

In exemplary embodiments, a sunshade device in accordance with the present invention includes a canopy with multiple extensions situated at opposite terminal ends of a perimeter of the canopy. In such embodiments, each extension may be independently pivoted or swung from a storage position (closed) to an extended position (opened)—allowing each extension to pivot about the perimeter of the canopy and securely rest at one or more angles—in a manner so that the extensions do not enclose or significantly obscure a user's view. In some embodiments, each extension may be positioned at varying angles. In other embodiments, one extension may be positioned at a first fixed angle, and the other extension may be positioned at a second fixed angle.

Using a sunshade device in accordance with the present invention allows for extending or maximizing the shaded area around the canopy by expanding the canopy's surface area. For example, in embodiments in which a plurality of extensions are situated in opposite terminal ends of the canopy: a first extension may be positioned at a first angle so that the first extension is elevated above the perimeter of the canopy; and a second extension may be positioned at a second angle so that the second extension is lowered below the perimeter of the canopy. In this way, especially if the sun is hitting the canopy at an angle (which is usually the case), each of the extensions provide a surface area that further expands the shaded area around the perimeter of the canopy.

When not in use, the sunshade device may be folded in a manner typical of foldable sunshades, which fold with the aid of a collapsible rib assembly that expands and collapses the canopy between open and close positions, respectively.

Figure 2:
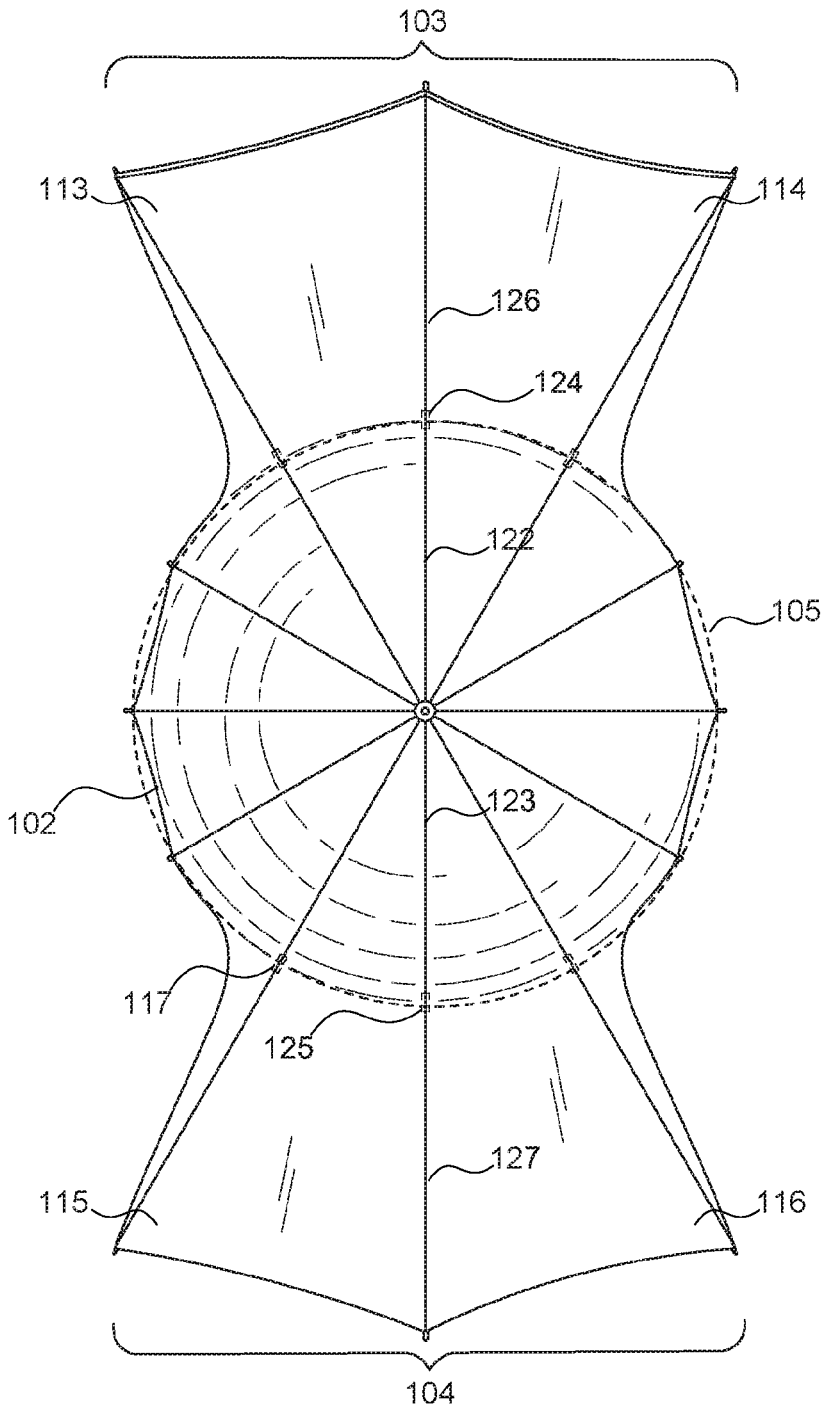
FIG. 2 illustrates a top view of a sunshade device in accordance with the present invention.

Turning now to the figures, FIG. 1 illustrates a perspective view of a sunshade device in accordance with the present invention. More specifically, FIG. 1 depicts sunshade 100, which comprises rib assembly 101 for supporting canopy 102, and extensions 103 and 104 that extend beyond a perimeter 105 (see also FIG. 2 depicting perimeter 105) of canopy 102.

Rib assembly 101 supports canopy 102 and is typically collapsible, although in some embodiments rib assembly 101 may be a static structure solely for supporting canopy 102 in an open or expanded configuration. In either embodiment, rib assembly 101 may be constructed using light metals or plastics, wood, or any other materials or combination of materials commonly used in the art for making such components. Whatever the case, rib assembly 101 should be strong enough and durable enough to support canopy 102 as well as extensions 103 and 104 when in the open or expanded positions.

Canopy 102 is primarily defined by perimeter 105 around shaft 106 that supports the rib assembly for folding and unfolding the canopy. Canopy 102 may be constructed of any known materials for constructing sunshades or umbrellas, including but not limited to linen, cotton, leather, silk, lace, nylon, or any other fabric or material, or combination of fabrics or materials. In an exemplary embodiment, canopy 102 may be constructed using microfiber fabrics that increase durability.

Extensions 103 and 104 are typically similar in construction with perhaps differences in the joint components (discussed further below with reference to FIG. 3(*a*)-FIG. 5(*c*)) that couple each extension to rib assembly 101. Extensions 103 and 104 may include one or more extension arms, such as extension arms 107, 126, 109 of extension 103, and extension arms 110, 127, 112 of extension 104. One or more canopy panels, such as canopy panel 113 and 114 of extension 103, and canopy panels 115 and 116 of extension 104 are supported by and situated in-between each extension arm of each extension 103 and 104.

In the shown embodiment, it may be noted that the canopy panels extend and are integral with panels from canopy 102 so that some panels of canopy 102 terminate at perimeter 105, while canopy panels 113, 114, 115, and 116 each extend beyond perimeter 105 of canopy 102 in an outwardly direction to terminal ends of their respective extensions 103 and 104. In alternative embodiments, canopy panels 113, 114, 115, and 116 are each constructed of a separate piece of fabric, are separate and distinct from canopy 102, and each panel commences at perimeter 105 of canopy 102. Thus, although shown in FIG. 1 as integral with canopy 102, in other embodiments, each canopy panel of each extension may be a separate and distinct panel of fabric without deviating from the scope of the present invention.

As mentioned above, extensions 103 and 104 may be situated at opposite terminal ends of perimeter 105 (i.e. as shown). However, other embodiments may include a single extension on a single side, two extensions on a single side of the canopy, or any other conceivable configuration without deviating from the scope of the present invention.

Similarly, each extension may be positioned at varying angles, at a similarly fixed angle, at different fixed angles, or in any other conceivable configuration without deviating from the scope from the present invention.

In exemplary embodiments, such as the embodiment shown in FIG. 1, one extension may be positioned at a first angle, and the other extension may be positioned at a second angle. For example, and without deviating from the scope of the present invention, extension 103 may employ a joint mechanism that allows extension 103 to pivot between an extended upright position such as that shown in FIG. 1, and a close position so that a top surface area of canopy panels 113 and 114 will make contact with a top surface area of canopy 102—this configuration allowing device 100 to be folded for storage purposes. Similarly, extension 104 may employ a joint mechanism that allows extension 104 to pivot between an extended lowered position such as that shown in FIG. 1, and a close position so that a top surface area of canopy panels 115 and 116 will make contact with a top surface area of canopy 102—this configuration allowing device 100 to be folded for storage purposes.

As shown, sunshade device 100 is depicted in an open or extended configuration with extension 103 extended upright and extension 104 extended downwards. In this configuration, the shaded area that may be created by perimeter 105 of canopy 102 is greatly expanded.

FIG. 2 illustrates a top view of sunshade device 100. More specifically, FIG. 2 depicts how extensions 103 and 104 expand canopy panels 113, 114, 115, and 116, respectively, beyond perimeter 105 (depicted in a dotted line) of canopy 102. Moreover, from this top view, a plurality of joint components—for example joint components 117, 124, 125 (also shown in dotted lines) on each extension 103 and 104 can be seen; these joint components allow extension 103 and 104 to be folded upwards or downwards, or as will be discussed below (in some embodiments) enable the adjustment of each extension at one or more angles.

It should be noted that although each panel of the canopy, including canopy panels 113-116, is shown as substantially triangular—which may be desirable for creating a substantially circular sunshade—device 100 may implement other shapes without deviating from the scope of the present invention. For example, as will be discussed further below, other embodiments may include substantially polygonal panels or substantially rectangular panels depending on the shape of the desired sunshade design.

Figure 3A:
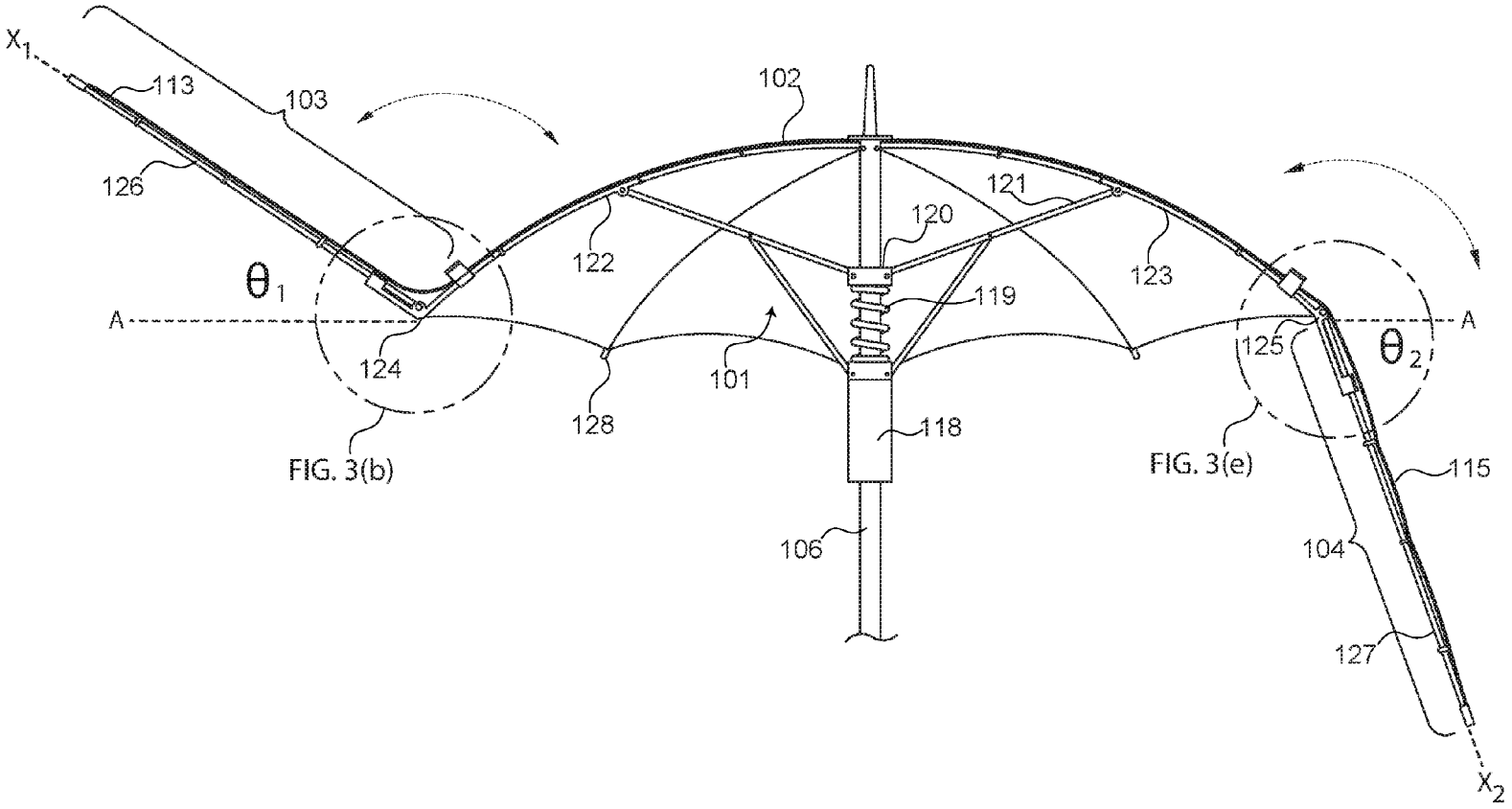
FIG. 3(*a*) illustrates a cross-sectional view of a sunshade device in accordance with the present invention.
Figure 3E:
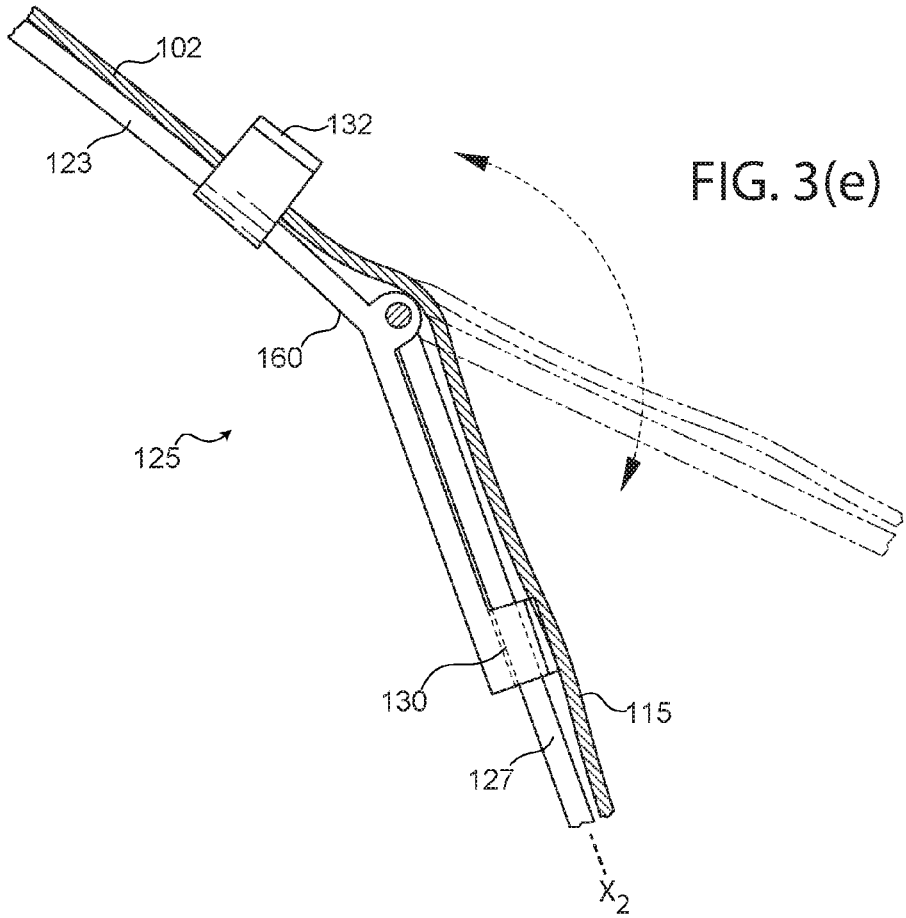
Figure 3F:
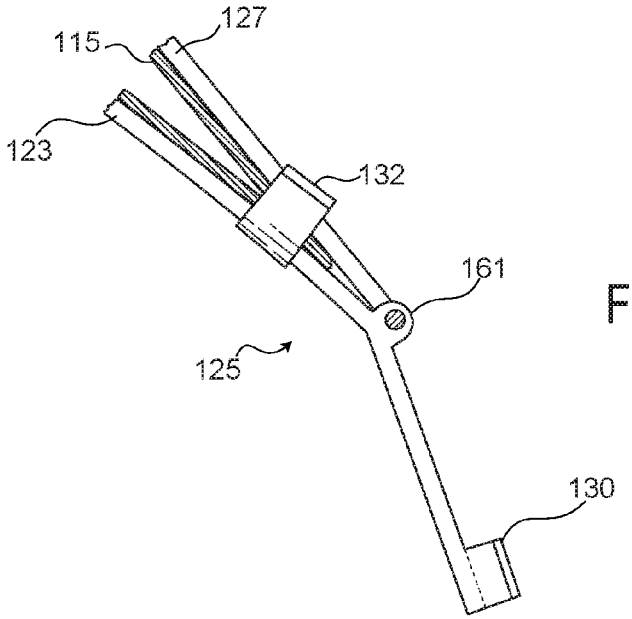
Figure 4A:
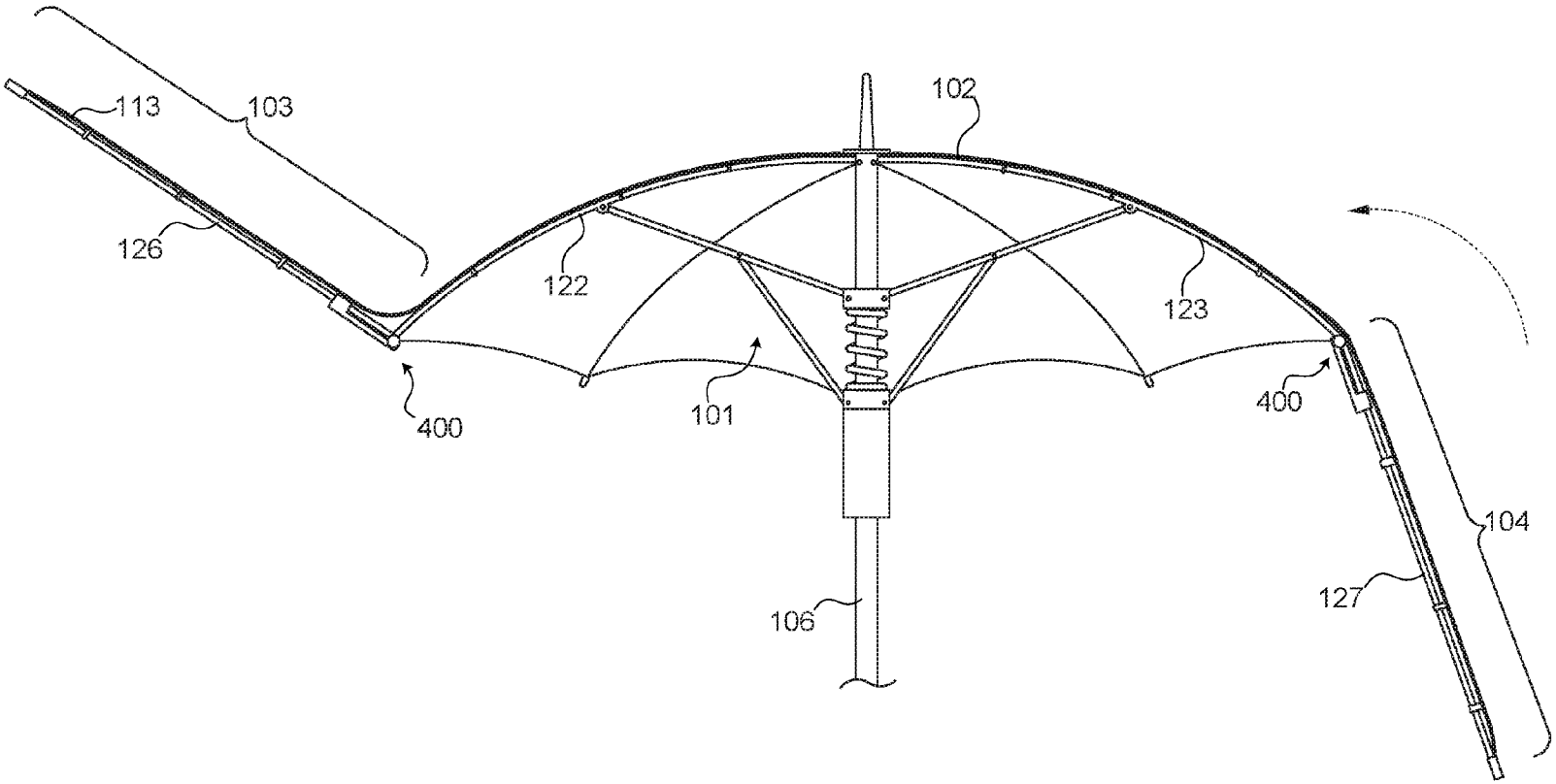
FIG. 4(*a*) illustrates a cross-sectional view of a sunshade device in accordance with another embodiment of the present invention, showing a rib assembly that employs extensions implementing similar joint components.
Figure 4B:
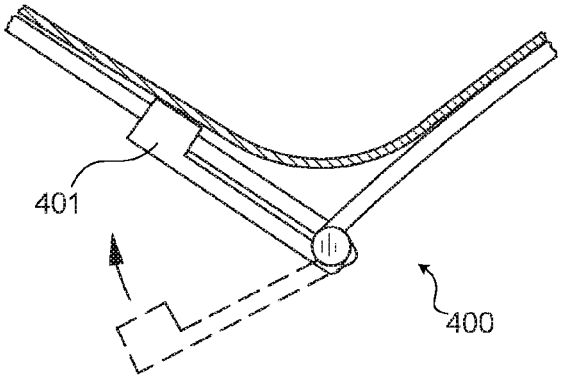
Figure 4C:
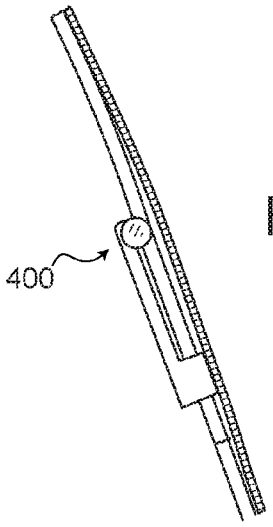
Figure 4D:
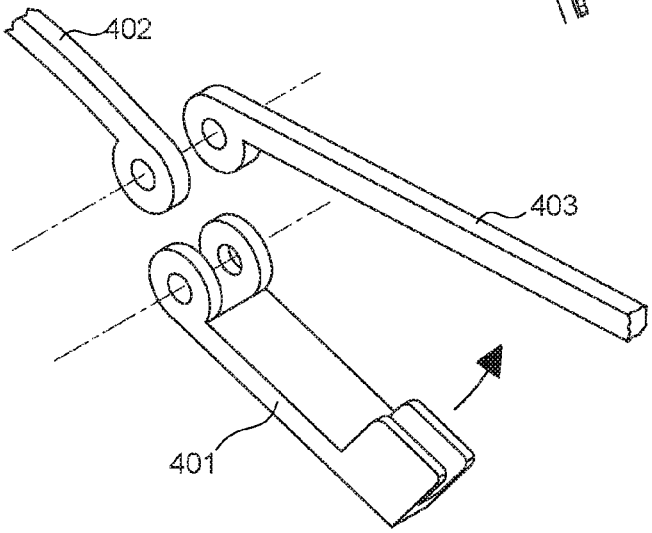

Turning now to the next figure, FIG. 3(*a*) illustrates a cross-sectional view of sunshade device 100, in accordance with one exemplary embodiment of the present invention. More specifically, FIG. 3(*a*) depicts various components of the device including rib assembly 101, as well as other components such as runner hub 118, spring 119, runner 120, stretchers 121, assembly arms 122 and 123, and extensions 103 and 104, which include joint components 124 and 125, and extension arms 126 and 127, respectively.

In the embodiment of FIG. 3(*a*), extensions 103 and 104 may be expanded (to an open position) at a set or fixed angle. That is, in such embodiment, each extension may employ joint components that are static and primarily support the extended extension arms when in the open or extended configuration. As will be discussed below with reference to other embodiments, joint components 124 and 125 may vary in design so as to allow different configurations and varying angle positioning of each extension 103 and 104 of sunshade device 100.

In the immediate embodiment, extension 103 comprises joint component 124, which is coupled to or extends from assembly arm 122 of rib assembly 101. Typically, assembly arm 122 is like any other assembly arm of the rib assembly 101; however, rather than terminate at a typical point, such as one of the plurality of tips 128, assembly arm 122 terminates at joint component 124. In one embodiment, joint component 124 is integral with assembly arm 122. In another embodiment, joint component 124 is a separate component from assembly arm 122 and may be attached to assembly arm 122 using any coupling means of securing joint component 124 to assembly arm 122. Either way, joint component 124 may connect rib assembly 101 to extension 103 by pivotally connecting assembly arm 122 to extension arm 126. Extension arm 126 supports canopy panels 113 and 114, which as mentioned above, may be integral with or separate from the one or more panels of canopy 102.

As mentioned above, in the immediate embodiment, joint component 124 is a static joint component; that is, joint component 124 provides support for extension arm 126 but restricts the pivotal movement of extension arm 126 to a set maximum first angle $\theta_1$ with respect to a surface parallel to plane A (i.e. assuming shaft 106 of sunshade device 100 is perpendicular to the ground), wherein $\theta_1$ may be a positive angle with respect to plane A and perimeter 105 of canopy 102 (roughly bound by a circumference defined in part between joint components 124 and 125—see also FIG. 2).

Accordingly, when sunshade device 100 is expanded at a typical outing (e.g. at the beach) a user may extend extension 103 by pivoting extension 103 outwardly up to a position $X_1$, thereby securing extension arm 126 to a coupling component 129 (see FIG. 3(*b*)) of joint component 124. In this way, extension 103 will securely rest at angle $\theta_1$ with respect to plane A and perimeter 105 of canopy 102. This configuration will extend the shaded area provided by canopy 102, which is otherwise limited by perimeter 105.

Similarly, the immediate embodiment employs extension 104 including joint component 125, which is coupled to or extends from assembly arm 123 of rib assembly 101. Like assembly arm 122, assembly arm 123 terminates at a joint component rather than one of the plurality of tips 128—terminating at joint component 125. In one embodiment, joint component 125 is integral with assembly arm 123. In another embodiment, joint component 125 is a separate component from assembly arm 123 and may be attached to assembly arm 123 using any coupling means of securing joint component 125 to assembly arm 123. Either way, joint component 125 may connect rib assembly 101 to extension 104 by pivotally connecting assembly arm 123 to extension arm 127. Extension arm 127 supports canopy panel 115, which as mentioned above, may be integral with or separate from the one or more panels of canopy 102.

As with joint component 124, joint component 125 provides support for extension arm 127 but restricts the pivotal movement of extension arm 127 to a set maximum second angle $\theta_2$ with respect to a surface parallel to plane A (i.e. again, assuming shaft 106 of sunshade device 100 is perpendicular to the ground), wherein $\theta_2$ is a negative angle with respect to plane A and perimeter 105 of canopy 102.

Accordingly, when sunshade device 100 is expanded for use at a typical outing (e.g. at the beach) a user may extend extension 104 by pivoting extension 104 outwardly down to a position $X_2$, thereby securing extension arm 127 to a coupling component 130 (see FIG. 3(*e*)) of joint component 125. In this way, extension 104 will rest at angle θ2 with respect to plane A and perimeter 105 of canopy 102. This configuration will further extend the shaded area provided by canopy 102, which is otherwise limited by perimeter 105.

Turning now to the next set of figures, FIG. 3(*b*)-FIG. 3(*f*) depict an exemplary embodiment of the joint components 124 and 125 discussed with reference to FIG. 3(*a*).

FIG. 3(*b*) illustrates joint component 124; FIG. 3(*c*) illustrates a front view of a coupling component employed by the rib assembly to hold extension arm 126 securely in place when in a closed configuration; and FIG. 3(*d*) illustrates the joint component depicted in FIG. 3(*b*), showing a portion of the canopy folded and held together in place by the coupling component (i.e. that is, in a closed configuration of extension 103). As depicted, in these figures, assembly arm 122 is integral with joint component 124 so that joint component 124 comprises a terminal end of assembly arm 122. Similarly, in the shown embodiment, canopy panel 113 is integral with or extends from a terminal end of canopy 102. As can be seen from these views, when extension 103 is in an opened configuration and extended upward (i.e. with respect to plane A), coupling component 129 may be used to secure extension arm 126 to joint component 124 so that extension arm 126 stays securely in place during use; this may be helpful to keep extension 103 steady during a windy day, for example. When extension 103 is placed in a closed configuration (i.e. away from position $X_1$; see FIG. 3(*d*)), extension arm 126 may be coupled securely to assembly arm 122 by means of coupling component 131, which may extend from or be connected to a portion of assembly arm 122 or may be part of joint component 124 without deviating from the scope of the present invention. Again, although not necessary, a benefit of component 131 is that such a coupling means may prevent extension 103 from opening up during storage of sunshade device 100.

FIG. 3(*e*) illustrates joint component 125, and FIG. 3(*f*) depicts a portion of the canopy folded and held together in place by a coupling component (i.e. that is, in a closed configuration of extension 104) of joint component 125. As depicted in these figures, assembly arm 123 is integral with joint component 125 so that joint component 125 is a terminal end of assembly arm 123. Similarly, in the shown embodiment, canopy panel 113 is integral with or extends from a terminal end of canopy 102. As can be seen from these views, when extension 104 is in an opened configuration and extended downward (i.e. with respect to plane A), coupling component 130 may be used to secure extension arm 127 to joint component 125 so that extension arm 127 stays securely in place during use, which may be helpful to keep extension 104 steady. When extension 104 is placed in a closed configuration (i.e. away from position $X_2$; see FIG. 3(*a*) and FIG. 3(*f*)), extension arm 127 may be coupled securely to assembly arm 123 by means of coupling component 132, which may extend from or be connected to a portion of assembly arm 123 or may be part of joint component 125 without deviating from the scope of the present invention. Again, although not necessary, a benefit of component 132 is that such a coupling means may prevent extension 104 from opening up during storage of sunshade device 100.

The next figures illustrate other exemplary embodiments of the present invention, which employ different types of joint components that be implemented to allow the positioning of the extensions at various angles.

Turning first to FIG. 4(*a*), a cross-sectional view of a sunshade device in accordance with another embodiment is illustrated. More specifically, FIG. 4(*a*) depicts an embodiment of sunshade device 100 that employs joint components 400 for adjusting extensions 103 and 104 at various angles. FIG. 4(*b*) and FIG. 4(*c*) illustrates a close-up view of joint components 400, depicting how the extensions of sunshade device 100 may be pivoted to a desired angle or folded for storage.

The primary distinction between joint components 400 and joint components 124 and 125, is that joint components 400 allow full pivoting motion of extensions 103 and 104, which may be desirable for users that may want to adjust each extension of the sunshade device at a particular angle. As such, joint components 400 may be referred to as dynamic joint components.

To better illustrate joint components 400, FIG. 4(*d*) depicts an exploded view. More specifically, joint component 400 is shown comprising coupling component 401, pivoting component 402, and pivoting component 403. Coupling component 401 may be used to secure an extending arm of sunshade device 100 once the joint component has been tightened to a desired angle or position, and in an exemplary embodiment such as the one shown in these figures, coupling component 401 may be used as the connecting means that supports pivoting components 402 and 403. Furthermore, the three components may be held together typically by a bolt and nut or similar known means of allowing the components to pivot, and that secure the components at a fixed position. For example, and without deviating from the scope from the scope the present invention, pivoting components 401 and 402 may be integral with other components of sunshade positioning device 100 and coupled in a manner that allows the extensions to pivot about joint component 400. In one embodiment, pivoting component 402 may be integral with assembly arm 122 and pivoting component 403 may be integral with extending arm 126; similarly, pivoting component 402 may be integral with assembly arm 123 and pivoting component 403 may be integral with extending arm 125. Where a typical nut and bolt means of coupling and securing the components 401, 402, 403 is utilized, a user may either tighten or loosen coupling component 400 in order to vary the angle at which a particular extension of sunshade device 100 may be desired. By way of example, joint components 400 have each been position in different angles as depicted in FIG. 4(*a*); of course, a user may decide to set extension 104 upright like extension 103 and vice versa because joint components 400 are dynamic and may provide for positioning at various angles.

Figure 5A:
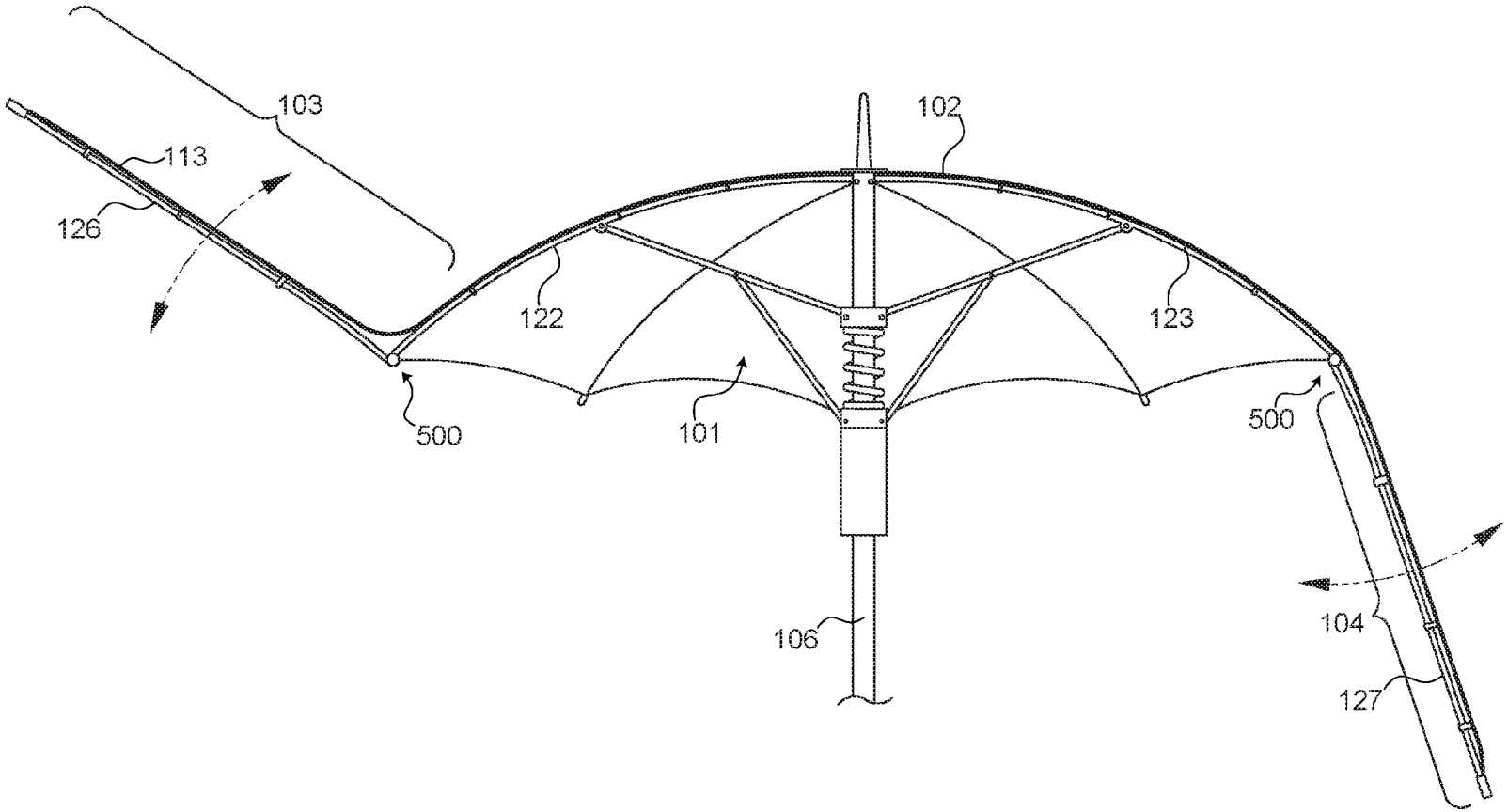
FIG. 5(*a*) illustrates a cross-sectional view of a sunshade device in accordance with another exemplary embodiment of the present invention, showing a rib assembly that employs two similar joint components at opposite ends of the canopy.
Figure 5B:
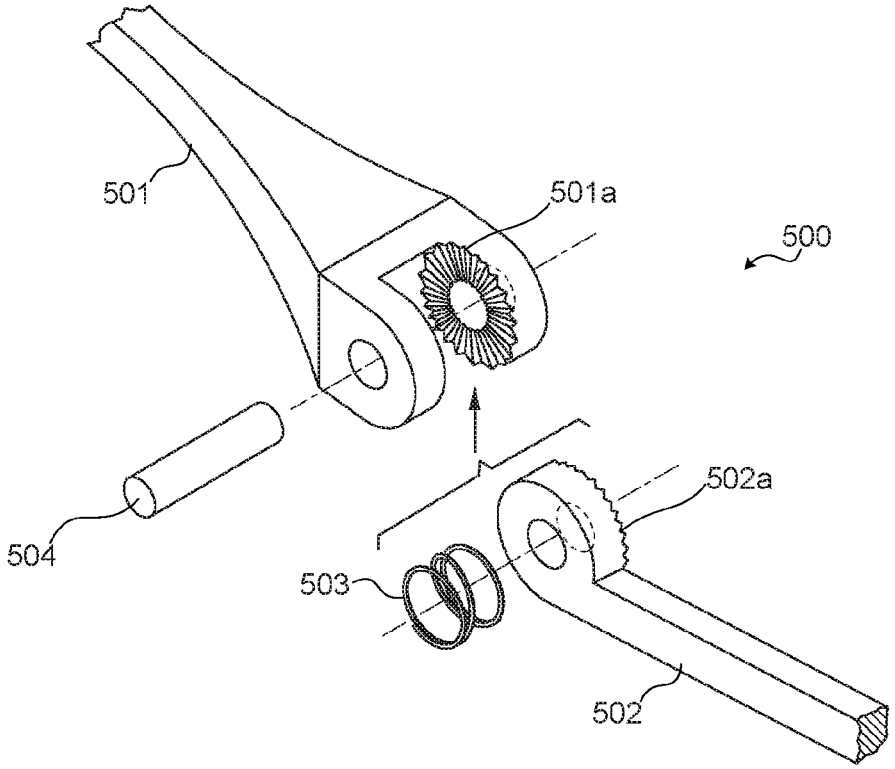
Figure 5C:
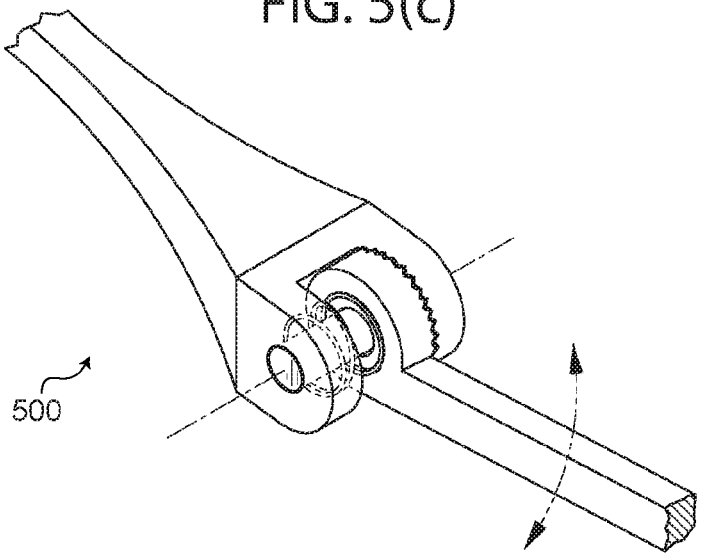

Turning now to the next set of figures, FIG. 5(*a*) illustrates a cross-sectional view of another exemplary embodiment of the present invention, showing a rib assembly that employs two similar joint components at each extension. As with joint components 400, joint components 500 are dynamic joint components and may be positioned by a user at different angles—these joint components do not have a fixed resting angle as joint components 124 and 125.

Accordingly, extensions 103 and 104 may be pivoted about joint components 500 without having to adjust each joint component independently, because each joint component 500 includes a spring-loaded mechanism that enables movement of the component, and a grooved component that fixes the component in place; this allows for each extension arm to be pivoted about each assembly arm, thereby allowing a user to rotate each extension of sunshade device 100 between a close position and a desired position that will maximize a shaded area.

FIG. 5(*b*) illustrates an exploded view of joint component 500. FIG. 5(*c*) illustrates a perspective view of the joint components 500 once assembled. More specifically, FIG. 5(*b*) depicts pivoting component 501, which may be a type of yolk component that receives pivoting component 502. Pivoting component 501 may include a grooved surface 501*a* that allows each pivoting movement to lock or securely stop at a predetermined place—which determines the angle position of the extension. Similarly, pivoting component 502 also includes a complimentary grooved surface 502*a* that registers with grooved surface 501*a*. Spring 503 rests against a sidewall of pivoting component 501 opposite to grooved surface 501*a* so as to force grooved surface 502*a* to engage or register with grooved surface 501*a*. Interlocking both components 501 and 502 together is typically a shaft 504. When assembled, joint components 500 will typically look as depicted in FIG. 5(*c*).

A benefit of joint components 500 is that a user does not need to manually tighten or adjust each joint component independently. Rather, a user may simply rotate, swing, or pivot each extension of sunshade device to a desired position.

It should further be noted that other types of joint components that are known in the art may be implemented without deviating from the scope of the present invention. For example, joint components may implement ball joints, elbow joints, knuckle joints, or any other type of pivoting or swinging means that achieves the same rotational motion and allows each extension of the sunshade device to be positioned at an angle with respect to the perimeter of the canopy. As such, the joint components discussed thus far are merely exemplary and are in no way meant to limit the scope of the present invention.

Figure 6:
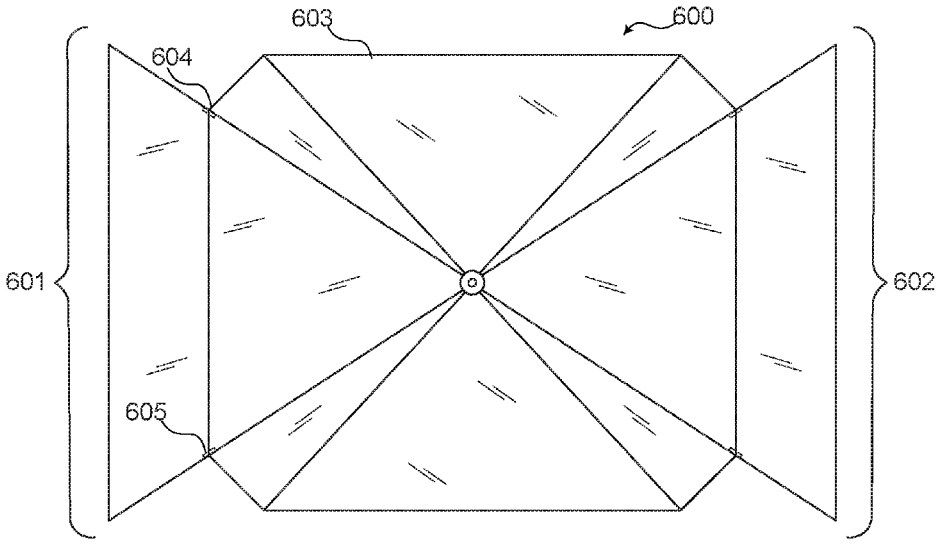
FIG. 6 illustrates a top view of one embodiment of the present invention, which includes a polygonal shape.

Similarly, although a rather typical canopy shape has been described thus far, as mentioned above, other types of canopies with varying perimeters and canopy panel shapes may be implemented without deviating from the scope of the present invention. By way of examples, FIG. 6 illustrates a top view of one embodiment of a canopy in accordance with the present invention, which includes a polygonal shape. More specifically, FIG. 6 depicts sunshade device 600, which includes extensions 601 and 602, each situated at opposite ends of canopy 603. Each extension 601 and 602 is pivotally coupled to canopy 603 with multiple joint components such as joint components 604 and 605. As explained above, extension 601 and 602 may be positioned at a desired angle with respect to a perimeter of canopy 603.

Figure 7:
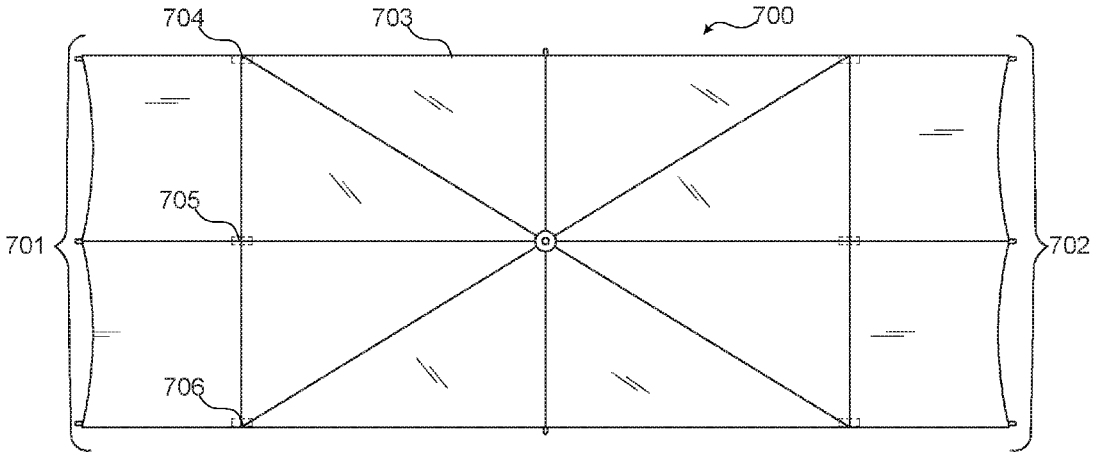
FIG. 7 illustrates a top view of one embodiment of the present invention, which includes a rectangular shape.

FIG. 7 illustrates a top view of one embodiment of a canopy in accordance with the present invention, which includes a rectangular shape. More specifically, FIG. 7 depicts sunshade device 700, which includes extensions 701 and 702, each situated at opposite ends of canopy 703. Each extension 701 and 702 is pivotally coupled to canopy 703 with multiple joint components such as joint components 704, 705, and 706. As explained above, extension 701 and 702 may be positioned at a desired angle with respect to a perimeter of canopy 703.

As may be appreciated by one skilled in the art, many variations on a sunshade device in accordance with the present disclosure may be achieved without deviating from the scope of the invention.

A sunshade device has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

DESCRIPTION OF THE REFERENCE SYMBOLS

100: Sunshade device
101: Rib Assembly
102: Canopy
103: Extension
104: Extension
105: Perimeter (i.e. of canopy 102)
106: Shaft
107: Extension arm
109: Extension arm
110: Extension arm
112: Extension arm
113: Canopy panel
114: Canopy panel
115: Canopy panel
116: Canopy panel
117: Joint component
118: Runner hub
119: Spring
120: Runner
121: Stretcher
122: Assembly arm
123: Assembly arm
124: Joint component
125: Joint component
126: Extension arm

127: Extension arm
128: Rib assembly tip
129: Coupling component
130: Coupling component
131: Coupling component
132: Coupling component
400: Joint component
401: Coupling component
402: Pivoting component
403: Pivoting component
500: Joint component
501: Pivoting component (yolk)
501*a*: Grooved portion
502: Pivoting component
502*a*: Grooved portion
504: Shaft
600: Sunshade device
601: Extension
602: Extension
603: Canopy
604: Joint component
605: Joint component
700: Sunshade device
701: Extension
702: Extension
703: Canopy
704: Joint component
705: Joint component
706: Joint component

What is claimed is:

1. A sunshade device, comprising:
a canopy expanding a perimeter around a central shaft;
a rib assembly coupled to the shaft and the canopy; and
a first and a second extension, each including:
extension arms pivotally coupled to assembly arms of the rib assembly at terminal ends of the extension arms, and
a canopy panel situated between the extension arms, wherein the first and second extensions are configured to:
pivot about the perimeter of the canopy, and
securely rest at a predetermined angle, wherein:
the first extension includes a first angled joint defined by a first angled surface that forms a positive angle with respect to a plane and is configured to receive a first extension arm in a manner so that the first extension arm rests on the first angled surface securely positioned at the positive angle and elevated above the perimeter of the canopy; and
the second extension includes a second angled joint defined by a second angled surface that forms a negative angle with respect to the plane and is configured to receive a second extension arm in a manner so that the second extension arm rests on the second angled surface securely positioned at the negative angle and lowered below the perimeter of the canopy.

2. The sunshade device of claim 1, wherein the first and second angled joints are integral with an assembly arm of the rib assembly.

3. The sunshade device of claim 1, wherein the first and second angled joints are separately coupled with an assembly arm of the rib assembly.

4. The sunshade device of claim 1, wherein the first and second extensions comprise of extensions situated at opposite sides on the perimeter of the canopy.

5. The sunshade device of claim 1, wherein the canopy comprises a polygonal shape and the first and second extensions comprise a trapezoidal shape.

6. The sunshade device of claim 1, wherein the canopy comprises a polygonal shape and the first and second extensions comprise a triangular shape.

7. The sunshade device of claim 1, wherein the canopy and the first and second extensions comprise a substantially rectangular shape.

8. A sunshade device, comprising:
a canopy expanding a perimeter around a shaft; and
a rib assembly coupled to the shaft and the canopy, the rib assembly including:
a first joint component coupled to a first assembly arm, the first joint component connecting a first extension arm to the first assembly arm of the rib assembly at a first angle with respect to a surface, wherein the first joint component comprises:
a first angled support member having a first angled surface that forms a positive angle with respect to a plane; and
a first coupling component situated at a terminal end of the first angled surface and adapted to receive the first extension arm at the positive angle so that the first extension arm securely rests on the first angled surface of the first joint component and is elevated above the perimeter of the canopy; and
a second joint component coupled to a second assembly arm, the second joint component connecting a second extension arm to the second assembly arm of the rib assembly at a second angle with respect to the surface, wherein the second joint component comprises:
a second angled support member having a second angled surface that forms a negative angle with respect to the plane; and
a second coupling component situated at a terminal end of the second angled surface and adapted to receive the second extension arm at the negative angle so that the second extension arm securely rests on the second angled surface of the second joint component and is lowered below the perimeter of the canopy.

9. The sunshade device of claim 8, wherein the first angled support member is integral with the first assembly arm of the rib assembly.

10. The sunshade device of claim 8, wherein the second angled support member is integral with the second assembly arm of the rib assembly.

* * * * *